US005289244A

United States Patent [19]

Takano

[11] Patent Number: 5,289,244

[45] Date of Patent: Feb. 22, 1994

[54] WRINKLE PREVENTION STRUCTURE FOR ELECTROPHOTOGRAPHIC PRINTER

[75] Inventor: Masatoshi Takano, Tokyo, Japan

[73] Assignee: Asahi Kogaku Kogyo Kabushiki Kaisha, Tokyo, Japan

[21] Appl. No.: 777,577

[22] Filed: Oct. 16, 1991

[30] Foreign Application Priority Data

Oct. 16, 1990 [JP] Japan ..... 2-108094[U]
Sep. 13, 1991 [JP] Japan ..... 3-082254[U]

[51] Int. Cl.[5] ..... G03G 15/20

[52] U.S. Cl. ..... 355/282; 219/216; 355/295

[58] Field of Search ..... 355/282, 285, 290, 295; 219/216

[56] References Cited

U.S. PATENT DOCUMENTS

| | | | |
|---|---|---|---|
| 4,017,067 | 4/1977 | Soures et al. | 355/282 X |
| 4,870,464 | 9/1989 | Itaya et al. | 355/290 X |
| 5,087,947 | 2/1992 | Torino | 355/290 |

FOREIGN PATENT DOCUMENTS

| | | |
|---|---|---|
| 3314153 | 10/1983 | Fed. Rep. of Germany . |
| 3811414 | 10/1988 | Fed. Rep. of Germany . |
| 57-39063 | 3/1982 | Japan . |
| 59-26769 | 2/1984 | Japan . |
| 60-22157 | 2/1985 | Japan . |
| 60-50568 | 3/1985 | Japan . |
| 63-135370 | 9/1988 | Japan . |
| 63-271381 | 11/1988 | Japan . |
| 1163790 | 6/1989 | Japan . |
| 1214569 | 8/1989 | Japan . |

OTHER PUBLICATIONS

Patent Abstract of Japan 60-50568.
Patent Abstract of Japan 63-271381.
English Language Translation of German Office Action of Dec. 10, 1992.
English translation of the claim of Japanese Document No. 57-39063.
English abstract of the Japanese Document No. 59-26769.
English abstract of the Japanese Document No. 60-22157.
English tranlation of the claim of Japanese Document No. 63-135370.
English abstract of Japanese Document No. 1-163790.
English abstract of Japanese Document No. 1-214569.

*Primary Examiner*—A. T. Grimley
*Assistant Examiner*—Shuk Y. Lee
*Attorney, Agent, or Firm*—Sandler, Greenblum and Bernstein

[57] ABSTRACT

A wrinkle prevention structure is employed in an electrophotographic imaging device using a continuous form recording sheet. The structure is provided with a guide member disposed on the upstream side of a pair of fixing rollers. The guide member has a guide surface extending substantially horizontally for guiding the recording sheet toward a nip between the pair of fixing rollers, and a tension surface arranged on downstream side of the guide surface. The upstream side end of the tension surface is connected with the downstream side end of the guide surface, the downstream side end of the tension surface is formed substantially arc-shaped, and the tension plane is upwardly inclined with respect to the guide surface.

7 Claims, 5 Drawing Sheets

WRINKLE PREVENTION STRUCTURE FOR ELECTROPHOTOGRAPHIC PRINTER

BACKGROUND OF THE INVENTION

The present invention relates to a structure of a heat roll fixing device to be adapted in an electrophotographic imaging device, and more specifically, to a wrinkle prevention structure in which a recording sheet is prevented from being wrinkled due to shrinking of the recording sheet caused by the heat applied from the heat roller.

Conventionally, a copy machine, a laser beam printer and the like are know as an electrophotographic imaging device wherein the uniformly charged surface of a photoconductive drum is exposed to light to form a latent image, charged toner is adhered to the latent image to form a toner image, and the toner image is transferred onto a recording sheet and fixed thereon by a fixing device.

The electrophotographic imaging device generally uses a so-called heat roll fixing device in which heat is applied to the toner image by a heated roller (heat roller) for fixing the toner image on a recording sheet.

The heat roll fixing device comprises a pair of fixing rollers composed of a heat roller and a press roller (also referred to as a backup roller). The heat roller is composed of a cylindrical roller having a heating element, such as a halogen lamp or the like, that is inserted therein and heated to a predetermined temperature. The press roller is made of a material, such as silicone rubber or the like, having a heat resistant property and a predetermined elasticity. A recording sheet carrying an unfixed toner image is caused to pass between the pair of fixing rollers to cause the toner image to be heated and pressed, so that the toner is fused and fixed onto the recording sheet. This kind of heat roll fixing device is advantageous in that it has an excellent heat efficiency, and the fixing operation can be performed at a high speed.

By the way, when the heat roll fixing is employed in an electrophotographic printer for forming an image on a continuous form sheet, such as a so-called fan-fold sheet provided with feed holes (hereinafter, simply referred to as a continuous sheet), and when the printer is in a standby state, the recording sheet (the continuous sheet) is held between the heat roller and press roller (in the state to be subjected to a succeeding fixing operation), and a drawback arises in that the same portion of the recording sheet contacts the heat roller and is burnt or blistered by the heat applied by the heat roller. To cope with this drawback, one roller of the pair of fixing rollers may be retracted so that a recording sheet does not contact the heat roller when the printer is in the standby state.

Nevertheless, even if the heat roller is retracted and spaced apart from the recording sheet when the printer is in the standby state, the recording sheet remaining in the fixing device is gradually heated by the heat roller which is kept heated to prepare for the succeeding image formation, and thus the recording sheet becomes dried and shrunk. In this condition, when the printing operation is restarted and the heat roller is returned to an operable position, the shrunken recording sheet whose original width has become narrower, is nipped between the heat roller and the press roller, and a problem arises in that the recording sheet is wrinkled after it has been passed through the pair of fixing rollers.

More specifically, when the recording sheet has been dried and shrunk, and the image forming operation (fixing operation) is started and the shrunken recording sheet is caused to pass between the pair of fixing rollers without correcting the shrunken state, wrinkles are formed. Further, the wrinkles continue to be formed until the portion of the recording sheet having an original width, which is neither heated nor dried is fed to the fixing device.

SUMMARY OF THE INVENTION

It is therefore an object of the present invention to provide a structure for preventing a recording sheet from being wrinkled in a heat roll fixing device by which a recording sheet is prevented from being wrinkled due to shrinking of the recording sheet, which is caused by the heat applied from a heat roller when a printer is in a standby state.

For the above object, according to the present invention, there is provided a wrinkle prevention structure employed in an electrophotographic imaging device using a continuous form recording sheet, the imaging device having a pair of fixing rollers, and the recording sheet carrying a unfixed image thereon and being fed to pass through the nip between the pair of fixing rollers to fix the image thereon. The wrinkle prevention structure of the present invention comprises:

a guide member disposed on the upstream side of the pair of fixing rollers with respect to the feeding direction of the recording sheet, wherein the guide member has:

(a) a guide surface substantially horizontally extending for guiding the recording sheet toward the nip between the pair of fixing rollers, the guide surface substantially coinciding with a horizontal plane including the nip between the pair of fixing rollers; and (b) a tension surface arranged on downstream side of the guide plane, the upstream side end of the tension surface being connected with the downstream side end of the guide surface, the downstream side end of the tension surface being formed substantially arc-shaped within a plane including the tension surface, the tension surface being upwardly inclined with respect to the guide surface, whereby the recording sheet is stretched at least in the width direction thereof before being nipped between the pair of fixing rollers.

DESCRIPTION OF THE ACCOMPANYING DRAWINGS

DESCRIPTION OF THE EMBODIMENTS

Figure 1:
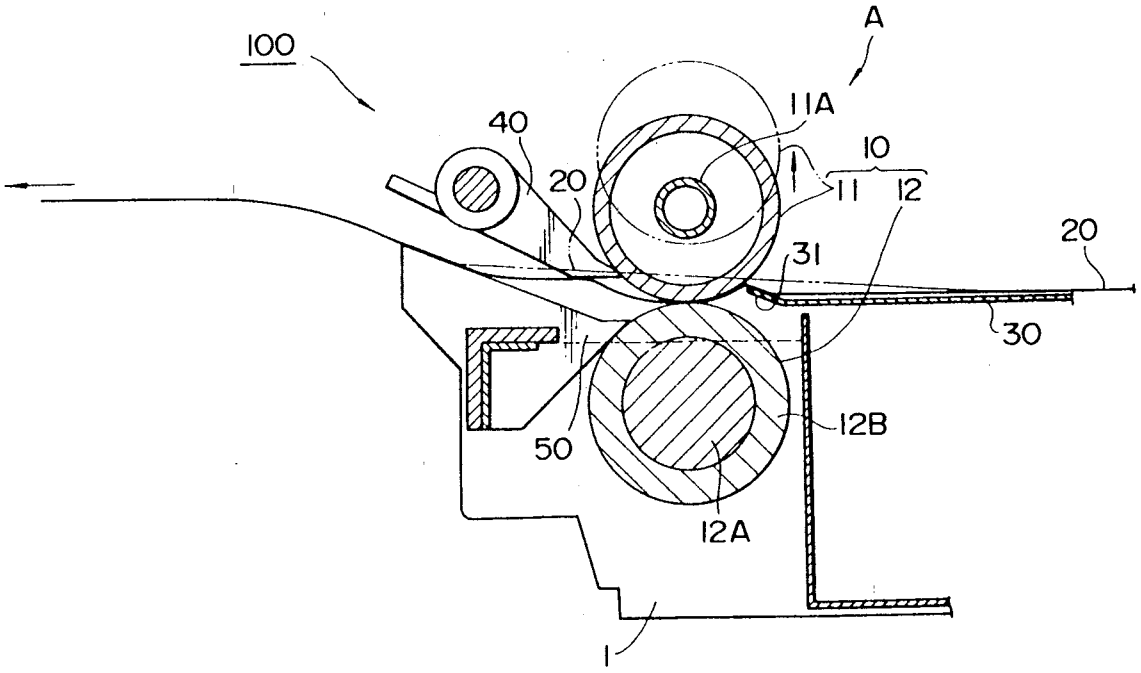
FIG. 1 is a cross sectional side view of a heat roll fixing device in which a wrinkle prevention structure for recording sheet embodying the present invention is employed.

FIG. 1 is a cross sectional view of a heat roll fixing device in which a wrinkle prevention structure embodying the present invention is employed.

In a fixing device 100 shown in FIG. 1, a pair of fixing rollers 10, composed of an heat roller 11 and a press roller 12, is arranged such that the rotary axis of each of the fixing rollers extends in the width direction of a recording sheet 20.

The heat roller 11 is a cylindrical roller having a halogen lamp 11A as a heating element inserted therein and heated to a predetermined temperature thereby. The heat roller 11 is supported by a not shown swingable lever at the opposite ends thereof, so that the heat roller 11 is retracted upwardly by the swinging action of the lever from an operable position, where the heat roller 11 contacts the press roller 12, to a retracted position, as shown by an imaginary line in FIG. 1. When the heat roller 11 is located at the retracted position, the outer circumferential surface of the heat roller 11 is spaced apart from the circumferential surface of the press roller 12 by a predetermined interval. Further, the heat roller 11 is driven by a not shown gear fixed at one end thereof.

The press roller 12 is a roller having a rubber layer 12B composed of silicone rubber or the like having a predetermined hardness formed around a core metal 12A, rotatably supported by a chassis 1 at the opposite ends thereof and pressed against the heat roller 11 by a predetermined pressure applied from a not shown spring.

A recording sheet guide 30 is disposed on the upstream side of the fixing rollers 10 in the sheet feed direction, with the guide plane of said sheet guide 30 extending substantially horizontally. The extreme end of the sheet guide 30 confronting the fixing rollers 10 is formed to be a bent portion 31 which functions as a tension applying means.

Figure 2:
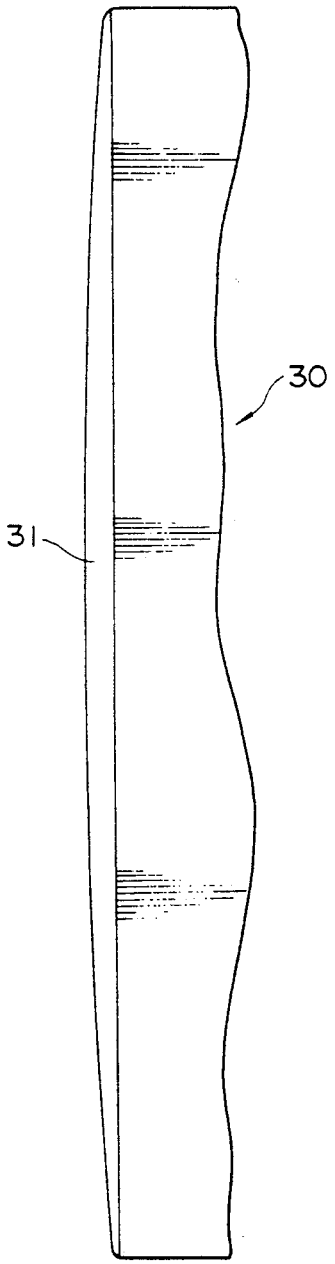
FIG. 2 is a fragmental view of FIG. 1 taken along the direction A.

FIG. 2 is the fragmentary view of FIG. 1 viewed from A. As shown in FIG. 2, the bent portion 31 is formed to be arc-shaped having a predetermined radius so that the center portion thereof is projected. Further, the bent portion 31 is bent upward at a predetermined angle. Thus constructed, the bent portion 31 is projected upwardly from the guide plane of the sheet guide 30 so that it interferes with the substantially horizontally defined sheet feed path along which the recording sheet is fed toward the nip between the pair of fixing rollers 10, and the amount of the interference becomes largest at the center in the width direction of the sheet guide 30.

A sheet separating claw 40 for separating the recording sheet 20 having been fixed from the heat roller 11 is disposed on the downstream side of the heat roller 11. Further, a sheet discharge guide 50 is disposed on the downstream side of the press roller 12.

With the fixing device arranged as above, when a fixing operation is performed, the heat roller 11 is heated to the predetermined temperature by the halogen lamp 11A and driven by a not shown drive means and the press roller 12 pressed thereagainst is also driven by the heat roller 11, and the recording sheet 20 carrying an unfixed toner image is thus nipped between the pair of fixing rollers 10 and the toner is fused and fixed on the recording sheet 20 by the heat applied from the heat roller 11.

When the printer is in a standby state, in which a printing operation including the fixing operation is paused, the heat roller 11 is retracted upwardly, as shown by the imaginary line in FIG. 1, so that the nip between the heat roller 11 and the press roller 12 is released. In this case, the heat roller 11 is still heated in preparation for the succeeding fixing operation.

Figure 3:
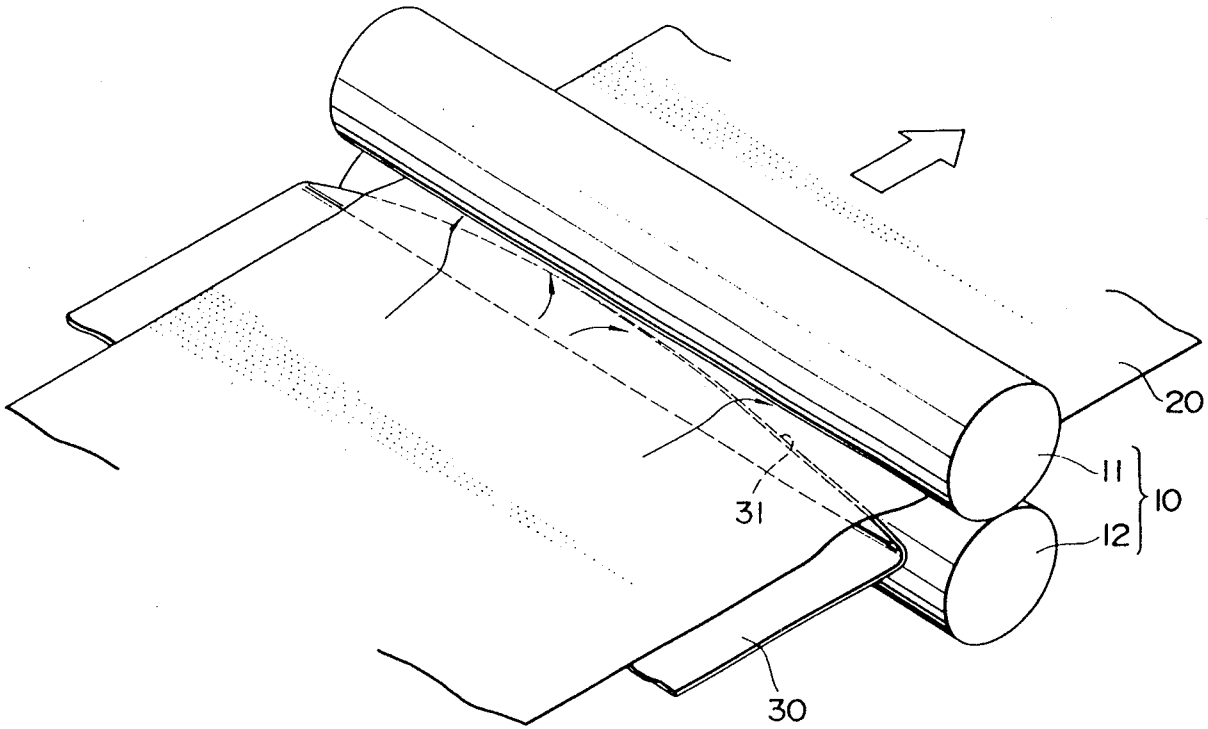
FIG. 3 is a perspective view showing the function of the wrinkle prevention structure.

When the fixing operation is restarted from the standby state, the heat roller 11 is located at the operable position to hold the recording sheet between the heat roller 11 and the press roller 12. At this time, the recording sheet 20 is abutted against the bent portion 31 of the recording sheet guide 30 and curved from the free state which is shown by an imaginary line in FIG. 1. As described above, the bent portion 31 is elevated at the center thereof and thus the path of the recording sheet 20 becomes slightly longer at the center thereof than at the side portions thereof. Accordingly, a tension in the width direction is applied to the recording sheet 20 with the bent portion 31 just before the recording sheet 20 is held between the fixing rollers 10, as shown in FIG. 3.

More specifically, when the printer is in the standby state, the portion of the recording sheet 20 located at the fixing device 100 is gradually heated and dried by the heat roller 11 and thus irregularly shrunk, but the shrunk portion is expanded by the bent portion 31, so that the recording sheet 2 is held between the heat roller 11 and the press roller 12 and passed therethrough without being wrinkled. Consequently, in the conventional printer employing a heat roll fixing device, wrinkles are formed as long as the portion of the recording sheet which is not shrunk is fed. On the other hand, according to the present invention, wrinkles caused due to the shrink of the recording sheet 20 occurred when heated and dried are not formed, even though the portion of the recording sheet 20 which has been shrunken is being fed at the fixing device 100.

FIGS. 4 through 7 show a modified sheet guide 30M as a modification of the above-describe embodiment, wherein the same numerals are used to denote the portions having the same functions as those of the above-described embodiment.

Figure 5:
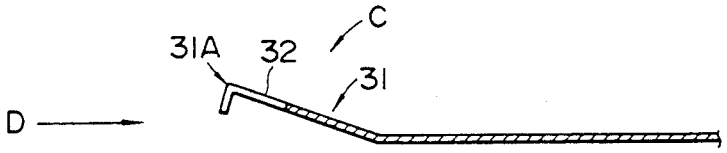
FIG. 5 is a cross sectional view taken along the line B—B of FIG. 4.

The modified embodiment is arranged such that the central extreme end of a bent portion 31 where the contact pressure of a recording sheet becomes largest (where the bent portion 31 has a maximum amount of interference with a recording sheet path) is bent downwardly to form a bent portion 31A as clearly shown in FIG. 5 so that the fed recording sheet 20 contacts a ridge of the bent portion 31A.

Slits 32, 32 are formed at the positions oppositely and equally apart from the lateral center of the bent portion 31. Thus the slits 32, 32 divide the bent portion 31 into a center portion, and two side portions 33, 33.

Figure 4:
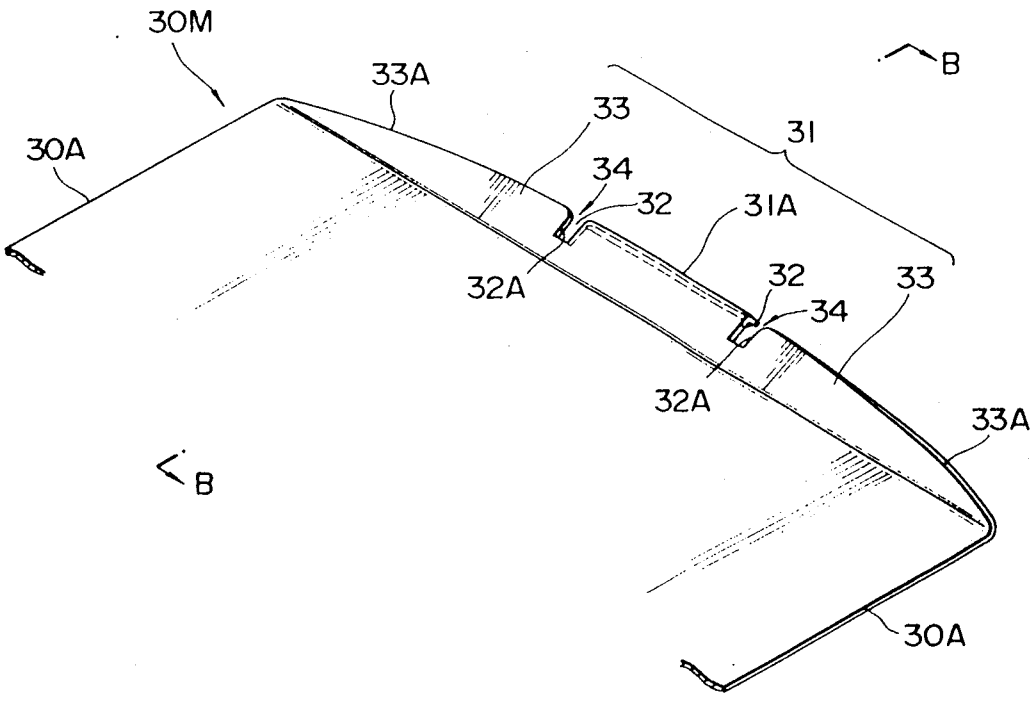
FIG. 4 is a perspective view of another embodiment of a wrinkle prevention structure.

The bent portion 31A is formed by downwardly bending the extreme end of the center portion of the bent portion 31 between the slits 32, 32 at a predetermined angle as shown in FIG. 5, which is a cross-sectional view taken along the line B—B of FIG. 4.

The extreme end edge 33A of each of the side portions 33, 33 is formed to connect the side end edge 32A of the slit 32 to the side end 30A of a recording sheet guide 30 by an arc having a predetermined radius, in the same way as the aforesaid embodiment.

Figure 6:
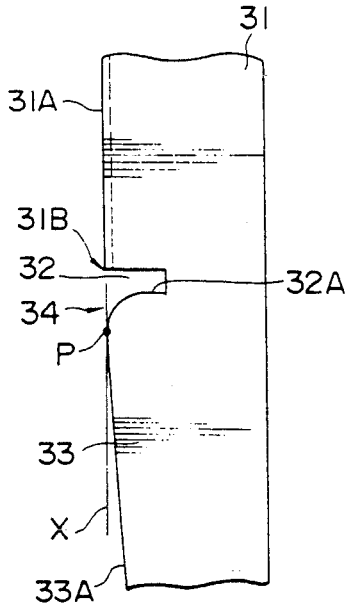
FIG. 6 is a fragmental view of FIG. 5 taken along the direction C.
Figure 7:
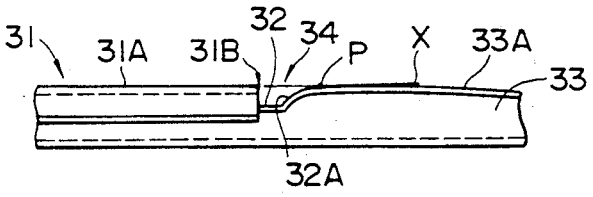
FIG. 7 is a fragmental view of FIG. 5 taken along the direction D.

The edge portion 34, which is defined by the extreme end edge 33A and the side end edge 32A of the slit 32, has an arc shape which is formed to connect the side end edge 32A with the line X which is obtained by extending the extreme end of the bent portion 31A in a side direction with an arc having a predetermined radius as shown in FIGS. 6 and 7. The extreme end edge 33A of the side portion 33 is formed to an arc shape starting from the point P at which the above arc is in contact with the line X.

With the above arrangement, since the center of the bent portion 31 where the contact pressure to the recording sheet 20 becomes maximized (where the bent portion 31 has a maximum amount of interference with the recording sheet path) is formed as the bent portion 31A, the bent portion 31A comes into contact with the back side (lower surface) of the recording sheet 20 at the ridge portion thereof. Constructed as above, since the recording sheet 20 does not contact the edge of the center portion of the bent portion, a rustle which is generated when the recording sheet is fed with its back surface rubbing against the edge of the bent portion 31 can be avoided.

Further, constructed as above, an edge portion 31B of the bent portion 31A confronting the slit 32 does not contact the back surface of the recording sheet 20, and the recording sheet 20 is neither caught nor damaged by the edge portion 31B.

As described above, according to the wrinkle prevention structure of the present invention, a recording sheet fed to the fixing device is caused to projected at the lateral center thereof from the plane leading to the nip between the heat roller and the press roller. Thus the recording sheet receives a tension in the width direction thereof, and the recording sheet which is irregularly shrunk is expanded before passing through the fixing device, and thus prevented from being wrinkled.

The present disclosure relates to subject matters contained in Japanese Utility Model Applications Nos. HEI 2-108094 (filed on Oct. 16, 1990) and HEI 3-82254 (filed on Sep. 13, 1991) which are expressly incorporated herein by reference in their entireties.

What is claimed is:

1. A wrinkle prevention structure employed in an electrophotographic imaging device using a continuous form recording sheet, said imaging device having a pair of fixing rollers, said recording sheet carrying an unfixed image thereon and being fed to pass through a nip between said pair of fixing rollers to fix the image thereon, said structure comprising a guide member disposed on an upstream side of said pair of fixing rollers with respect to a feeding direction of said recording sheet, said guide member comprising:

(a) a guide surface extending substantially horizontally for guiding said recording sheet toward the nip between said pair of fixing rollers, said guide surface substantially coinciding with a horizontal plane including the nip between said pair of fixing rollers; and (b) a tension surface arranged on a downstream side of said guide surface, an upstream side end of said tension surface being connected with a downstream side end of said guide surface, a downstream side end of said tension surface being formed substantially arc-shaped, said tension surface being upwardly inclined with respect to said guide surface, whereby said recording sheet is stretched at least in a width direction thereof before being nipped between said pair of fixing rollers.

2. The wrinkle prevention structure according to claim 1, wherein both edges of the downstream side end of said tension surface are connected with side edges of said guide surface at the downstream side end of said guide surface.

3. The wrinkle prevention structure according to claim 1, wherein said tension surface is formed with a pair of slits, said slits being arranged symmetrically with respect to a longitudinal center of said tension surface, a portion of the downstream side end of said tension surface between said pair of slits being downwardly bent by a predetermined amount to form a bent portion so that the recording sheet contacts a ridge of said bent portion.

4. The wrinkle prevention structure according to claim 3, wherein said tension surface has outside portions that are not located between said pair of slits, a downstream side end of each of said outside portions being arc-shaped, a distance between the downstream side end of each of said outside portions and a portion where said tension surface is connected with said guide surface being greatest at a portion adjacent to a respective one of said slits, an end of a portion connecting an end confronting said slit and the portion at which said distance is greatest being arc-shaped, said distance being equal to a distance between said ridge of said bent portion and the portion where said tension surface is connected with said guide surface.

5. A wrinkle prevention structure employed in an electrophotographic imaging device using a continuous form recording sheet, said imaging device having a pair of fixing rollers, said recording sheet carrying an unfixed image thereon and being fed to pass through a nip between said pair of fixing rollers to fix the image thereon, said structure comprising a guide member disposed on an upstream side of said pair of fixing rollers with respect to a feeding direction of said recording sheet, wherein said guide member comprises a guide surface extending substantially horizontally for guiding said recording sheet toward the nip between said pair of fixing rollers, said guide surface substantially coinciding with a horizontal plane including the nip between said pair of fixing rollers, wherein said guide member further comprises tensioning means on a downstream side of said guide surface for upwardly pressing said recording sheet at least at a center portion in a width direction thereof so that said center portion of said recording sheet is projected from a plane including a portion of said recording sheet traveling on said guide surface.

6. The wrinkle prevention structure according to claim 1, said pair of fixing rollers comprising a heat roller disposed above a press roller, said press roller contacting an outer underside surface of said heat roller, said heat roller and said press roller being separated from each other when said imaging device is in a print stand-by mode.

7. The wrinkle prevention structure according to claim 5, said pair of fixing rollers comprising a heat roller disposed above a press roller, said press roller contacting an outer underside surface of said heat roller, said heat roller and said press roller being separated from each other when said imaging device is in a print stand-by mode.

* * * * *